United States Patent [19]

Kettler

[11] Patent Number: 4,674,793

[45] Date of Patent: Jun. 23, 1987

[54] FOLDING CHAIR

[76] Inventor: Heinz Kettler, 4763 Ense, Fed. Rep. of Germany

[21] Appl. No.: 807,160

[22] Filed: Dec. 10, 1985

[30] Foreign Application Priority Data

Dec. 14, 1984 [DE] Fed. Rep. of Germany ... 8436612[U]

[51] Int. Cl.[4] ..... A47C 4/00

[52] U.S. Cl. ..... 297/28; 297/359; 297/440

[58] Field of Search ..... 297/27, 28, 359, 440, 297/443, 16, 46; 403/159, 163, 119

[56] References Cited

U.S. PATENT DOCUMENTS

| | | | |
|---|---|---|---|
| 1,636,529 | 7/1927 | Motschman | 403/159 |
| 2,292,831 | 8/1942 | Gilkison | 297/443 X |
| 2,305,562 | 12/1942 | Thompson et al. | 403/159 |
| 2,659,416 | 11/1953 | Heyman . | |
| 2,664,148 | 12/1953 | Rechler | 297/440 |
| 2,872,969 | 2/1959 | Thomas | 297/28 |
| 3,136,272 | 6/1964 | Sprigman | 297/16 |
| 3,321,239 | 5/1967 | Cosper | 297/440 X |
| 4,125,249 | 11/1978 | Zen | 403/119 X |

FOREIGN PATENT DOCUMENTS 3309186 4/1984 Fed. Rep. of Germany .

*Primary Examiner*—Francis K. Zugel
*Attorney, Agent, or Firm*—Erwin S. Teltscher

[57] ABSTRACT

A folding chair includes two pairs of front and rear legs which are arranged at opposite sides of a seat and support the same in a substantially horizontal orientation in a position of use of the folding chair. A backrest is pivotally connected to the rear portion of the seat for movement between a plurality of inclined positions. Two armrests are hingedly connected to the backrest and extend frontwardly therefrom. The front and rear legs of each pair assume a configuration of an inverted V, and are connected to one another at their upper ends by a hinge which includes two insertable members articulated to one another, each having an insertion portion fittingly received in a hollow end portion of the respective leg. Each insertion portion has two resilient tongues at opposite sides thereof, which carry respective protuberances that are received in corresponding openings of the legs. One of the insertable members is provided with an upwardly extending arresting nose which engages, in each inclined position of the backrest, a different one of a plurality of spaced holding projections provided on the underside of the respective armrest. Each armrest is provided at its rear end with a bearing pin which extends into a blind hole of the backrest upon assembly. The bearing pin has a connecting projection and the backrest has a recess through which the projection passes into the blind hole during assembly.

6 Claims, 12 Drawing Figures

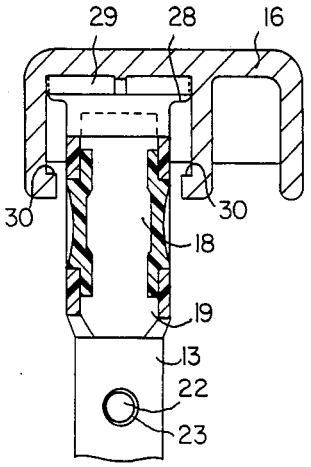
FIG. 4
FIG. 5
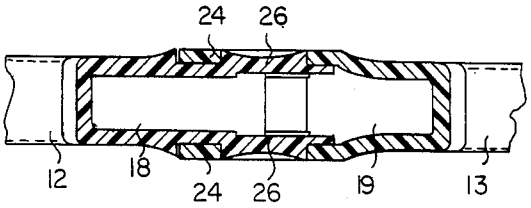
FIG. 6
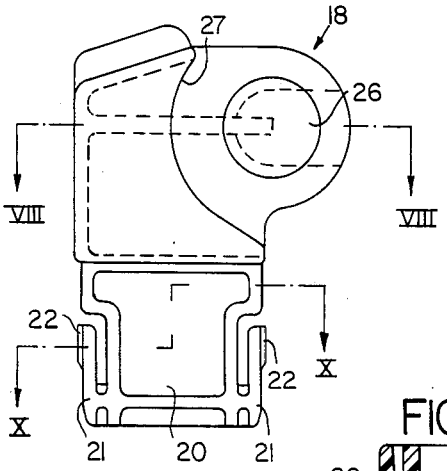
FIG. 7
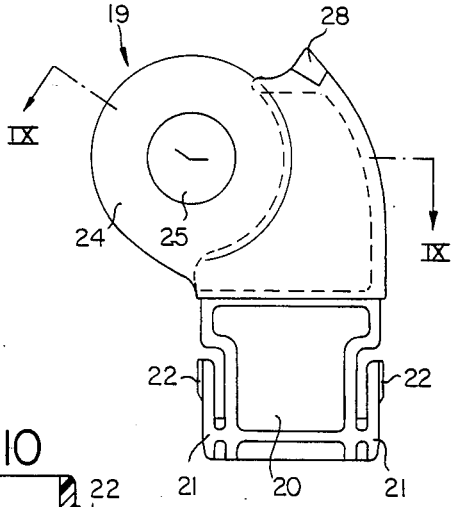
FIG. 10
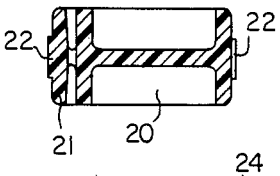
FIG. 8
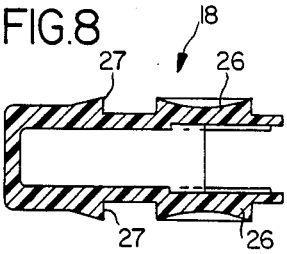
FIG. 9
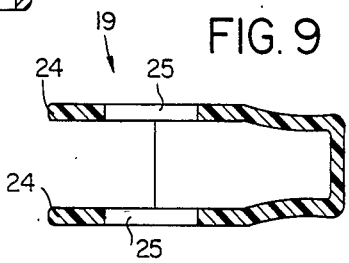

FIG. 11
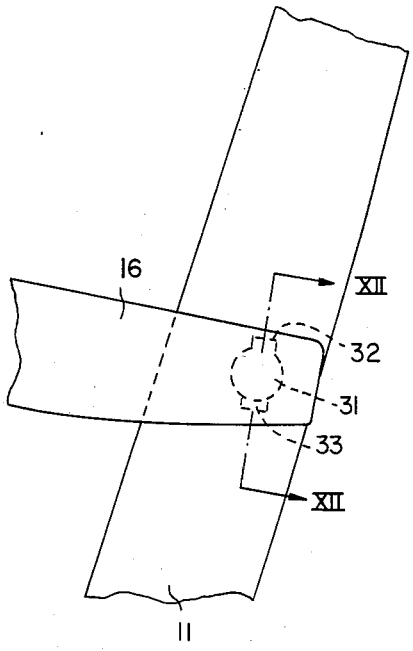
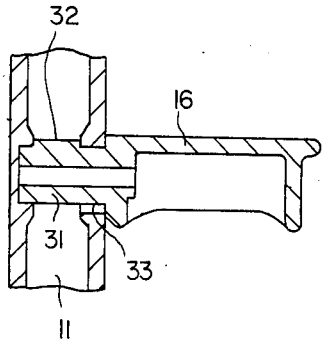
FIG. 12

FOLDING CHAIR

BACKGROUND OF THE INVENTION

The present invention relates to folding chairs in general and more particularly to folding chairs with reclining backrests which can be used for sitting and/or for lying thereon.

In known constructions of folding chairs of the above type, there are provided two pairs of front and rear legs, which are arranged at the sides of a seat and support such seat in a substantially horizontal position when the chair is unfolded for use. An upright backrest is pivotally connected to the rear portion of the seat for movement between a plurality of inclined positions. Two armrests are connected to the backrest at opposite sides thereof and extend frontwardly from the backrest to be supported on the upper ends of the respective pairs of legs; each leg pair typically assumes an orientation resembling an inverted V. Connecting or adjusting arrangements are then provided between the legs of each pair and the respectively associated armrest, and serve for arresting the armrests and thus the backrest in any selected position of the latter.

A folding chair of this type is known, for instance, from the U.S. Pat. No. 2,603,273. In this construction, one of the legs of each of the pairs whose legs assume the aforementioned inverted-V orientations extends upwardly beyond the seating surface and is operatively connected at its upper region with the respectively associated armrest. In this connection, it is also known to provide an arresting arrangement on the armrest, such arrangement extending longitudinally of the armrest, and to provide a pin on the aforementioned one leg, which pin engages the arresting arrangement. However, experience has shown that this construction, as well as other known folding chair constructions, leave much to be desired in terms of simplicity of construction, ease of assembly, and handling capability.

SUMMARY OF THE INVENTION

Accordingly, it is a general object of the present invention to avoid the disadvantages of the prior art.

More particularly, it is an object of the invention to provide a folding chair which does not have the disadvantages of known chairs of this type.

It is yet another object of the present invention to so construct the chair of the type here under consideration that it can be easily assembled and easily disassembled.

Still another object of the present invention is to so design the chair as to be simple in construction, relatively inexpensive to manufacture, and reliable in operation nevertheless.

In accordance with the present invention, the above-mentioned objects are achieved in that each of the connecting arrangements includes a hinge which is arranged at the upper end of the respective pair of legs and supports the respective associated armrest; this hinge includes a front insertable part and a rear insertable part, which are respectively inserted into hollow end portions of the respective legs of the pair along the axial directions of the respective legs.

In the folding chair of the above construction, the front leg and the rear leg of each of the pairs extend obliquely upwardly so that the upper ends of these legs are situated adjacent to one another, giving the leg pair the appearance of an inverted V. At the upper end of this respective leg pair, there is arranged the hinge which simultaneously also serves as a support for the armrest and as an abutment for an arresting engagement of the armrest in a selected position. For the adjustment of the inclination of the backrest, the armrests are lifted and in this manner are disengaged from the hinge, so that the armrests can then be displaced in their longitudinal directions with respective hinges in their lifted positions.

It is particularly advantageous in the context of the present invention, if each of the front and rear insertable members of the hinge is provided with an insertion portion which has a cross section corresponding to the internal cross-sectional configuration of the respective front or rear leg upper end portion. The insertable portions can then be axially inserted into the respective legs in a very easy manner, and can be secured in their inserted positions, so that it is not necessary to provide each of the legs at its upper end with an expensive connecting arrangement.

The novel features which are considered as characteristic of the invention are set forth in particular in the appended claims. The invention itself, however, both as to its construction and method of operation, together with additional objects and advantages thereof, will best be understood from the following description of the specific embodiments read in connection with the accompanying drawings.

BRIEF DESCRIPTION OF THE DRAWING

FIG. 4 is a vertical section through the connecting region, taken on line IV—IV of FIG. 3;

FIG. 5 is a horizontal section through the connecting region, taken on line V—V of FIG. 3;

FIG. 6 is a side elevational view of a front insertable member of the hinge of FIG. 3;

FIG. 7 is a side elevational view of a rear insertable member of the hinge of FIG. 3;

FIG. 8 is a horizontal section through the front insertable member, taken on line VIII—VIII of FIG. 6;

FIG. 9 is a horizontal section through the rear insertable member, taken on line IX—IX of FIG. 7;

FIG. 10 is a horizontal section through the front insertable member, taken on line X—X of FIG. 6;

FIG. 11 is a side elevational view of a connection region between an armrest and a backrest of the folding chair of FIG. 1; and FIG. 12 is a sectional view through this connection region taken on line XII—XII of FIG. 11.

DETAILED DESCRIPTION OF THE PREFERRED EMBODIMENT

Figure 1:
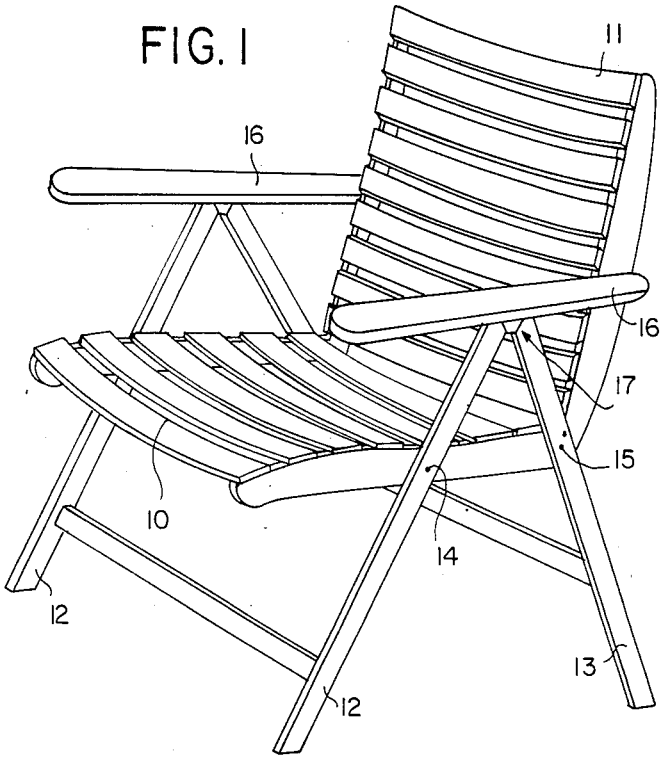
FIG. 1 is a perspective view of a folding chair in its position of use.
Figure 2:
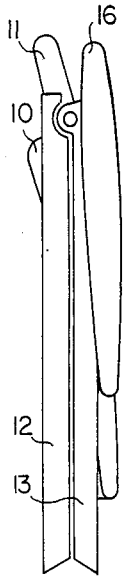
FIG. 2 is a side elevational view of the folding chair of FIG. 1 in its folded state.

Referring now to the drawing in detail, and first to FIGS. 1 and 2 thereof, it may be seen that they depict a folding chair, constructed in accordance with the present invention, in its position of use and in its folded position, respectively. As shown in FIG. 1, the folding chair includes a generally or approximately horizontal seat 10 and a backrest 11 which extends upwardly from the rear portion of the seat 10. A leg pair consisting of a front leg 12 and a rear leg 13 is arranged at each side of the seat 10. These two legs 12 and 13 extend obliquely upwardly and they are connected at their upper ends, so that they are arranged to resemble an inverted V. The seat 10 is mounted on the front legs 12 by means of hinges 14 for pivoting about a horizontal axis, and is provided at its rear end with a hinged connection 15 connecting the seat 10 with the backrest 11, which is mounted on the rear leg 13.

Figure 3:
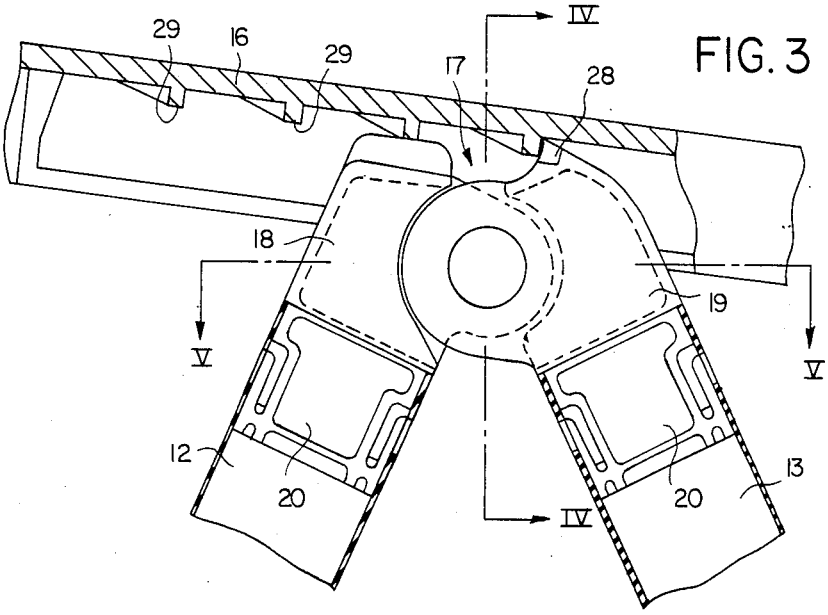
FIG. 3 is a partially sectioned side elevational view of a connecting region between a front leg, a rear leg, and an armrest of the folding chair of FIG. 1.

At the two sides of the backrest 11, there are mounted respective rear ends of two armrests 16. The armrests 16 extend forwardly from the backrest 11 substantially parallel to the seat 10 and are supported along their course on respective hinges 17 which are supported by the respective leg pairs. As shown, for instance, in FIG. 3 of the drawing, each hinge 17 consists of an longitudinal front insertable member 18 and an longitudinal rear insertable member 19. Each insertable member 18 and 19 is provided with an insertion portion 20, which is inserted in an axial direction into a respective end portion of the associated leg 12 or 13. The insertable members 18 and 19 can be advantageously made of a synthetic plastic material, while the front leg 12 and the rear leg 13 of each of the leg pairs is a tubular body with a rectangular cross section which may advantageously be made of a metallic material, so that there results a thin-walled construction.

As shown particularly clearly in FIGS. 6, 7, and 10 of the drawing, the respective insertion portion 20 of the respective insertable member 18 or 19, which is substantially rectangular in cross-section, is provided, at two mutually parallel sides of its rectangular cross section, with resilient tongues 21 on which there are formed outwardly projecting connecting protuberances 22. These connecting protuberances 22 serve for arresting the respective insertion portion 20 either in the front leg 12 or in the rear leg 13. To this end, the legs 12 and 13 are provided with respective receiving bores 23 which are shown in FIG. 4 and are fitted to the connecting protuberances 22. During the insertion of the insertion portion 20 into the interior of either the front leg 12 or the rear leg 13, the tongues 21 carrying the connecting protuberances 22 elastically yield in contact with the inner surface of the respective rectangularly shaped end of portion of the respective leg 12 or 13, until the connecting protuberances 22 reach the receiving bores 23 and engage therein with snap action. For withdrawing the insertion portion 20 from the respective end portion of the tubular leg 12 and 13, it is therefore necessary to push the connecting protuberances 23 from the exterior of the respective leg 12 or 13 out of the receiving bores 23, and into the interior of the respective leg 12 or 13.

The rear insertable member 19 is provided, as a comparison of FIGS. 5 to 9 with one another will reveal, with two parallel vertical walls which are constructed and function as bearing rings 24. These walls are arranged at a predetermined distance from one another, and are provided with aligned bearing openings 25. The bearing rings 24 can be resiliently bent apart from one another, so that it is possible to introduce a region of the front insertable part 18, which is provided with two outwardly projecting horizontal bearing pins 26, between the bearing rings 24 of the rear insertable member 19, until the bearing pins 26 enter the bearing openings 25 with snap action. The outer diameters of the bearing pins 26 correspond to the inner diameters of the bearing openings 25, so that the front insertable member 18 and the rear insertable member 19 can be pivoted toward one another at these bearing locations. In this manner, the rear insertable member 19 partially surrounds the front insertable member 18. In addition to the above, the bearing rings 24 have cylindrical boundaries, which are juxtaposed with correspondingly cylindrical contact surfaces 27 of the front insertable member 18, so that there can result a further sliding connection of the hinge 17.

The rear insertable member 19 is provided at its upper portion with an upstanding arresting nose 28. This arresting nose 28 is provided and arranged for engagement with one of a plurality of holding studs or projections 29 which are formed at the underside of the armrest 16, as particularly shown in FIG. 3. These holding projections 29 are provided on the armrest 16 at regular or uniform spacings from one another in the longitudinal direction of the armrest 16, and they extend thereat parallel to the pivoting axis of the hinge 17, that is, transversely to the armrest 16. A different inclined position of the backrest 11 corresponds to each of the engaged conditions of the arresting nose 28 with one of the holding projections 29. The arresting nose 28 and the respective holding projection 29 become disengaged from one another, when the armrest 16 is lifted, so that the respective armrests 16 can be moved when both are lifted in their longitudinal directions relative to the hinge 17 either frontwardly or rearwardly and in this manner the inclination of the backrest 11 can be adjusted or changed, until the holding projection 29 corresponding to the desired inclined position of the backrest 11 has reached a position upwardly of the respective arresting nose 28. At this time, the position of the backrest 11 can be fixed by lowering the armrests 16 with attendant engagement of the respective holding projection 29 with the arresting nose 28.

The upward movement of the armrests 16 during their pivoting about their pivoting axis arranged at the backrest 11 is limited by abutment edges 30 which are provided at vertical webs of the armrests 16 and are situated underneath the arresting nose 28 of the hinge 17. These abutment edges 30 contact, in a raised position of the respective armrest 16, the ends of the arresting nose 28 which project beyond the axial thickness of the hinge 17.

Each armrest 16 is connected to the backrest 11 in a particularly simple manner, as shown in FIGS. 11 and 12. To this end, the backrest 11 is provided, at each of its lateral delimiting bars, with respective blind holes, into which there are inserted bearing pins 31 of the armrest 16. Each bearing pin 31 is provided at the rear end of the respective armrest 16 and extends laterally from the latter toward the respective lateral bar of the backrest 11 in the assembled state of the folding chair. Each bearing pin 31 includes a connecting extension 32 provided at the periphery of the bearing pin 31, for which there is provided in the lateral bar of the backrest 11 a recess 33, which extends from the inner surface of the blind hole. In the assembled state, the connecting extension 32 extends from the bearing pin 31 upwardly, while the associated recess 33 is provided in the lateral bar of the backrest 11 below the bearing pin 31. Thus, in order to remove the armrest 16, the latter must be rotated through 180°, so that the connecting extension 32 and the recess 33 come into alignment with one another. Only under these circumstances is it then possible to disassemble the respective armrest 16 from the backrest 11 by withdrawing the bearing pin 31 from the blind hole of the lateral bar of the backrest 11 along the longitudinal direction of the bearing pin 31. Mounting of the armrest 16 on the backrest 11 occurs in a reverse sequence.

While the invention has been illustrated in preferred embodiments, it is not to be limited to the structures shown, since many variations thereof will be evident to one skilled in the art, and are intended to be encompassed in the present invention as set forth in the following claims.

I claim:

1. A folding chair for use as a sitting and/or lying furniture, comprising in combination a seat;

two pairs of front and rear legs arranged at respective sides of said seat and supporting said seat, said legs of each of said pairs being arranged with respect to one another in the configuration of an inverted V at least in a position of use, being tubular throughout, and having substantially rectangular cross-sections, an upright backrest pivotally connected to said seat and movable relative thereto between a plurality of inclined positions;

two armrests each hingedly connected to said backrest and extending frontwardly therefrom in said position of use; and connecting means for joining said legs of each of said pairs and one of said armrests with one another in a selected one of said inclined positions of said backrest, including a hinge arrangement releasably engaging one armrest and having elongated front and rear insertable members, respectively, axially inserted into said end portions of said front and rear legs of the respective pair in an assembled condition of the chair, wherein each of said front and rear insertable members includes an insertion portion with a cross-section corresponding to that of the interior of the respective leg into which said insertion portion is to be fittingly inserted, wherein each of said legs of the respective pair includes two aligned receiving bores, and each of said insertion portions includes thereon, at mutually opposite sides, respective protuberances, which are fittingly received in said receiving bores of the respective leg upon insertion of the respective insertion portion into the interior of such leg, wherein each of said insertion portions includes, at each of said mutually opposite sides thereof, a tongue carrying the respective protuberance and being resiliently displaceable toward the interior of the respective leg during and upon assembly therewith, wherein said front insertable member of said hinge arrangement includes two bearing pins projecting from a hinging portion of said front insertable member, and wherein said rear insertable member has two elastically yieldable walls embracing said hinging portion of said front insertable member, and having bearing openings receiving said bearing pins.

2. The folding chair as defined in claim 1, wherein said rear insertable member of said hinge arrangement includes two bearing rings which are parallel to one another, and are provided with aligned horizontal bearing openings.

3. The folding chair as defined in claim 1, wherein said backrest is provided with a blind hole at each of the regions of hinged connection with the respective armrest, and wherein each of said armrests carries at its rear end a bearing pin which is received in the respective one of said blind holes upon assembly of the respective armrest with the backrest.

4. The folding chair as defined in claim 3, wherein said bearing pin has at its periphery a connecting projection; and wherein said backrest is provided with a recess which opens into said blind hole and being dimensioned to permit fitting passage of said connecting projection therethrough into and out of said blind hole during the assembly and disassembly of the respective armrest and of said backrest.

5. The folding chair as defined in claim 1, wherein said elastically yieldable walls of said rear insertable member are bearing rings having cylindrical boundaries, and being spaced at a predetermined distance from one another, and wherein said front insertable member is formed with cylindrical contact surfaces corresponding to said cylindrical boundaries, and being slidably juxtaposed with the latter.

6. The folding chair as defined in claim 1, wherein each arm rest is longitudinal, and is provided with a plurality of holding studs at regular spacings from one another at an underside thereof along the longitudinal direction of the armrest, and wherein said rear insertable member is provided at an upper portion thereof with an upstanding arresting nose selectably engageable with one of said holding studs upon the armrest being moved from a lifted position to an engaged position, whereby the inclination of said backrest can be adjusted until, upon lifting of said armrest, one of said holding studs corresponding to the the desired inclined position of said backrest has a position upwardly of the respective arresting nose, and said armrest is subsequently moved downwardly to engage said one of said holding studs.

* * * * *